US007811417B2

(12) United States Patent
MacHattie et al.

(10) Patent No.: US 7,811,417 B2
(45) Date of Patent: Oct. 12, 2010

(54) CROSS-MACHINE DIRECTION ACTUATORS FOR MACHINE CLOTHING

(75) Inventors: Ross K. MacHattie, Mississauga (CA); Ron E. Beselt, Burnaby (CA)

(73) Assignee: Honeywell ASCA, Inc., Mississauga (CA)

( * ) Notice: Subject to any disclaimer, the term of this patent is extended or adjusted under 35 U.S.C. 154(b) by 493 days.

(21) Appl. No.: 11/603,786

(22) Filed: Nov. 22, 2006

(65) Prior Publication Data

US 2007/0151690 A1 Jul. 5, 2007

Related U.S. Application Data

(60) Provisional application No. 60/755,623, filed on Dec. 30, 2005.

(51) Int. Cl.
*D21F 3/02* (2006.01)

(52) U.S. Cl. ..... 162/263; 162/272; 162/275; 700/129

(58) Field of Classification Search ..... 162/252–253, 162/263, 265, 272, 275, 278–279, 198–199; 700/127–129
See application file for complete search history.

(56) References Cited

U.S. PATENT DOCUMENTS 3,279,976 A * 10/1966 Eagle et al. ..... 162/275
3,910,815 A * 10/1975 Shelor ..... 162/199
4,087,320 A * 5/1978 Danahy et al. ..... 162/252
4,152,202 A * 5/1979 DeLigt ..... 162/198
4,167,440 A * 9/1979 Falk ..... 162/277
4,880,499 A * 11/1989 Pikulik ..... 162/198
4,980,846 A * 12/1990 Chapman ..... 700/167
5,020,469 A * 6/1991 Boissevain et al. ..... 118/67
5,595,632 A * 1/1997 Macierewicz ..... 162/277
5,725,737 A * 3/1998 Pikulik et al. ..... 162/263
5,900,117 A * 5/1999 Lidar ..... 162/199
5,928,475 A * 7/1999 Chase et al. ..... 162/198
6,080,278 A * 6/2000 Heaven et al. ..... 162/198
6,086,716 A * 7/2000 Watson et al. ..... 162/198
6,126,785 A * 10/2000 Hu et al. ..... 162/198
6,168,687 B1 * 1/2001 Hu et al. ..... 162/198

(Continued)

FOREIGN PATENT DOCUMENTS

WO WO 9742373 A1 * 11/1997

OTHER PUBLICATIONS

Devienne Drummond et al, "Otimization of felt life time in paper manufacture," no Dated.*

*Primary Examiner*—José A Fortuna
(74) *Attorney, Agent, or Firm*—Cascio Schmayer & Zervas

(57) ABSTRACT

A method for affecting moisture content of a sheet of paper includes providing a moisture measuring device disposed in a papermaking machine to measure the moisture content of a sheet of paper and create a moisture profile of the sheet of paper, determining the moisture profile of the sheet of paper, and providing a water-spraying device to spray water on a press felt that contacts the sheet of paper during manufacturing. The method further includes selecting one or more zones on the press felt on which to spray water based on the moisture profile of the sheet of paper, and acting on the press felt by spraying water in the one or more selected zones on the press felt to affect the moisture content of the sheet of paper that contacts the press felt after the water has been sprayed.

9 Claims, 5 Drawing Sheets

U.S. PATENT DOCUMENTS

| | | | | |
|---|---|---|---|---|
| 6,179,964 | B1 * | 1/2001 | Begemann et al. | 162/198 |
| 6,638,395 | B1 * | 10/2003 | Elenz | 162/202 |
| 6,655,195 | B2 * | 12/2003 | Grabscheid et al. | 73/73 |
| 6,716,316 | B2 * | 4/2004 | Grabscheid et al. | 162/199 |
| 7,147,164 | B1 * | 12/2006 | Burma | 235/472.02 |
| 7,431,800 | B2 * | 10/2008 | Ferm et al. | 162/259 |
| 7,513,975 | B2 * | 4/2009 | Burma | 162/263 |
| 2002/0112532 | A1 * | 8/2002 | Grabscheid et al. | 73/73 |
| 2003/0010460 | A1 * | 1/2003 | Grabscheid et al. | 162/199 |
| 2004/0129398 | A1 * | 7/2004 | Munch et al. | 162/198 |
| 2004/0194903 | A1 * | 10/2004 | Pease et al. | 162/199 |
| 2004/0221978 | A1 * | 11/2004 | Tran et al. | 162/198 |
| 2004/0261965 | A1 * | 12/2004 | Burma | 162/198 |
| 2005/0145356 | A1 * | 7/2005 | Heikkinen et al. | 162/198 |
| 2006/0111808 | A1 * | 5/2006 | Burma | 700/129 |
| 2006/0185809 | A1 * | 8/2006 | Elfrink et al. | 162/198 |
| 2007/0151689 | A1 * | 7/2007 | Beselt | 162/198 |
| 2007/0151690 | A1 * | 7/2007 | MacHattie et al. | 162/198 |
| 2008/0066884 | A1 * | 3/2008 | Tran et al. | 162/198 |
| 2009/0095432 | A1 * | 4/2009 | MacHattie et al. | 162/198 |
| 2009/0128799 | A1 * | 5/2009 | MacHattie et al. | 356/5.05 |
| 2009/0205796 | A1 * | 8/2009 | MacHattie et al. | 162/198 |

* cited by examiner

CROSS-MACHINE DIRECTION ACTUATORS FOR MACHINE CLOTHING

CROSS-REFERENCE TO RELATED APPLICATION

The present application claims priority from U.S. provisional application 60/755,623 filed on Dec. 30, 2005.

TECHNICAL FIELD

The invention relates generally to actuation systems in papermaking machinery, and more particularly to actuation systems acting upon machine clothing, specifically press felts.

BACKGROUND OF THE INVENTION

Conventional papermaking machinery for producing a continuous sheet of paper includes equipment to set the sheet properties of the paper as the sheet of paper is being manufactured. Generally, on-line measurements of sheet properties, such as thickness, moisture, gloss, or smoothness are made by scanning sensors that travel back and forth across the width of the sheet of paper in the cross-machine direction (CD). The scanning sensors are located downstream of actuators that are controlled to adjust the sheet properties. The scanning sensors collect information about the sheet properties to develop a property profile across the sheet and provide control signals to the appropriate actuators to adjust the profile toward a desired target profile in a feedback loop. In practice, the actuators provide generally independent adjustment at adjacent cross-directional locations of the sheet, normally referred to as slices or profile zones.

Other configurations include an array of non-scanning sensors disposed across the width of the sheet that collect information about the sheet properties to develop a property profile across the sheet and, as described above, provide control signals to the appropriate actuators to adjust the profile toward a desired target profile in a feedback loop.

One of the more basic operations on a papermaking machine is control of the cross-direction moisture profile by heating the paper sheet in zones with a steambox that is typically located in a press section of the papermaking machine. Cross-direction moisture profiles can also be controlled by using re-wet actuators (e.g., water sprays administered by spray nozzles) typically located near the reel. By applying water to the drier areas of a sheet, a uniform CD moisture profile can be created.

In the manufacturing of a flat sheet of paper, the cross-machine direction uniformity is a critical issue. Current automation systems use measurements, control algorithms, and actuators to directly control the various sheet characteristics in multiple zones across the sheet. As an example, in the paper industry, it is common to have cross-machine direction actuators that add steam in various zones across the sheet to increase the temperature of the water, which facilitates better removal of the water in those zones, but usually results in reduced sheet bulk. Later in the sheet manufacturing process, it is common to spray water on the sheet in zones, which further affects the cross-machine direction moisture content of the sheet. However, adding water is not energy efficient and can result in greater variation in paper quality than if only the correct amount of water was removed from the sheet. Machine clothing is used to assist in transporting the sheet along the papermaking machine. Machine clothing also aids in the removal of water and other solvents from the sheet during the manufacturing process. For example, it is common to use machine clothing (i.e., press felts) to accompany the sheet through a press nip and function as a repository for the water that is mechanically removed from the sheet. As the sheet moves through the papermaking machine, the press felt re-circulates and is washed and dried and made ready to assist in transporting the sheet along the papermaking machine. All of the actions on the press felt are typically in the machine direction (MD).

Typically, actuation systems act directly on the sheet. However, actuators can act upon process equipment, which then, in turn, transfer an effect to the sheet, such as heating zones on calendar stacks or press zones in press rolls. Missing from the cross-machine direction control of flat sheets are actuators that act upon the cross-machine direction properties of the machine clothing, particularly press felts. Because the press felt directly affects the paper sheet quality, any cross-machine direction characteristics of the press felt that are affected are transferred to the sheet of paper.

SUMMARY OF THE INVENTION

The invention relates generally to actuation systems in papermaking machinery, and more particularly to actuation systems acting upon machine clothing, specifically press felts.

The invention provides a method, system and apparatus for affecting moisture content of a sheet of paper during manufacturing by a papermaking machine, by acting upon the papermaking machine's clothing rather than the sheet of paper itself. The inventive technique involves measuring the moisture content of a first section of the sheet of paper using a moisture measuring device in the papermaking machine and creating a moisture profile of the first section of the sheet of paper, providing a water-spraying device to spray water on the press felt, selecting one or more zones on the press felt in which to spray water based on the moisture profile of the first section of the sheet of paper, and spraying water in the one or more selected zones on the press felt to affect the moisture content of a subsequent section of the sheet of paper that contacts the press felt after the water has been sprayed. In addition, a vacuum device for removing water from the press felt by suction can be provided. Also, water can be removed from one or more other selected zones on the press felt based on the moisture profile of the first section of the sheet of paper, and the press felt can be acted upon so that water can be removed from the one or more other selected zones to affect the moisture content of the subsequent section of the sheet of paper that contacts the press felt after the water has been removed. Further the press felt can be washed and dried before spraying water in the one or more selected zones on the press felt.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

The present invention is a system and method that involves acting upon paper machine clothing (i.e., press felts), rather than the sheet of paper itself, to affect the moisture content of the sheet of paper during paper manufacturing.

It has been observed that the water absorption efficiency of the press felt is affected by the amount of water in the press felt. Current systems tend to clean and dry the press felt as efficiently as possible. If the press felt is too dry, it impedes the transfer of water from the sheet of paper to the press felt. The solution is to re-wet the press felt before the press felt comes into contact with the sheet of paper. By changing the amount of water applied in any given zone across the press felt, the cross-machine direction efficiency of the water removal from the sheet of paper can be changed. If too much water is added to the press felt, the maximum water absorption efficiency will be reduced because the capacity of the press felt for absorbing water from the sheet of paper is reduced. With advanced papermaking machine controls, it is possible to load the press felt with water to increase the average water absorbing efficiency to a maximum while still maintaining sufficient dynamic range to be able to manipulate the cross-machine direction moisture variation to maximize cross-machine direction moisture uniformity of the sheet of paper.

Figure 1:
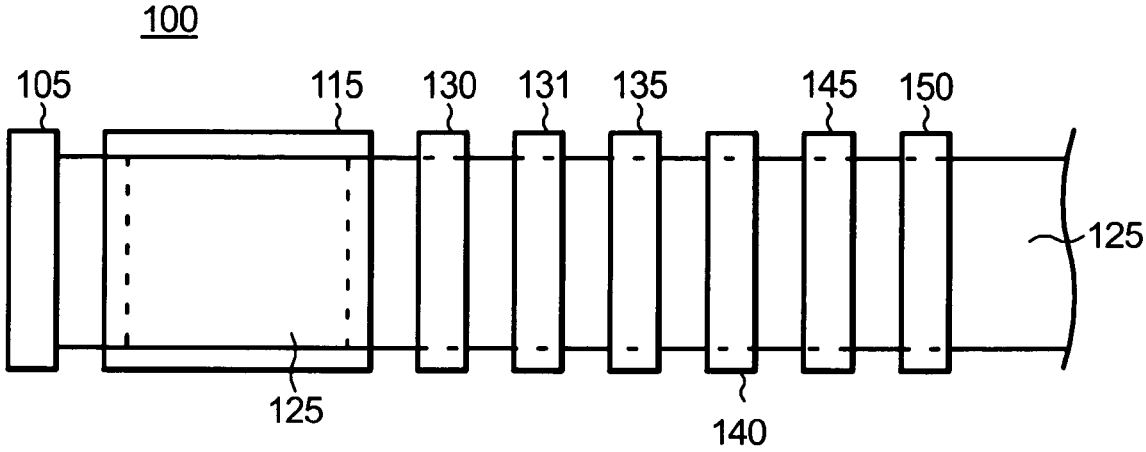
FIG. 1 is an illustrative top view schematic diagram of a papermaking machine, according to one embodiment of the invention.

Referring to FIG. 1, in one embodiment, a schematic diagram of a typical papermaking machine 100 is shown. The papermaking machine 100 includes a headbox 105, a wire 115, a suction roll 130, a press felt feeding mechanism 131, a steam box 135, a press section roll pair 140, a dryer felt feeding mechanism 145, and a steam cylinder 150. In other embodiments, more press section roll pairs and more steam cylinders can be used.

In order to make paper, a tree is first ground and/or chemically digested into fibers and mixed with water. The fiber-water mixture (stock) is supplied to the head box 105 via a pipe (not shown). At this point, the fiber-water mixture (stock) is approximately one percent fiber and ninety-nine percent water. The goal is to remove most of the water to achieve a water content of approximately 5 percent. The head box 105 distributes the stock to the wire 115 through a thin but wide slot thereby forming a continuous thin sheet 125.

The wire 115 is a mesh of plastic filaments. The wire 115 moves the thin sheet 125 along in the machine direction and water drains from the thin sheet 125. This section is referred to as the forming section. Underneath the wire 115 are various vacuum boxes and foils (not shown) that create pressure to further facilitate the removal of water from the thin sheet 125. By the time the thin sheet 125 has been moved to the end of the forming section (i.e., the end of the wire 115) of the papermaking machine 100, the mixture is approximately twenty percent fiber and eighty percent water and the fibers stick together to maintain the integrity of the thin sheet 125. As the thin sheet 125 is moved off the wire 115, a suction roll 130 holding press felt 210 positioned above the thin sheet 125 transfers the thin sheet 125 to the bottom side of the press felt 210 via suction. Thereafter, another press felt 211 is fed under the thin sheet 125 by the press felt feeding mechanism 131. This results in a section of the continuous thin sheet 125 being disposed between press felt 210 and press felt 211, as shown in FIG. 2.

The press felts 210 and 211 circulate in separate closed loops and act as reservoirs to collect (absorb) water from the thin sheet 125 via pressing and capillary action. The section of the thin sheet 125 supported by the press felts 210 and 211 is moved past the steam box 135. The steam box 135 operates in the cross-machine direction (CD) (across the width of the thin sheet 125) and blows steam on the thin sheet 125 (typically in six inch increments in the cross-machine direction) to heat the thin sheet 125 and cause the remaining water to become less viscous so that the water can be more easily absorbed by the press felts 210 and 211. The purpose of this function is to control the moisture profile across the thin sheet 125.

Figure 2:
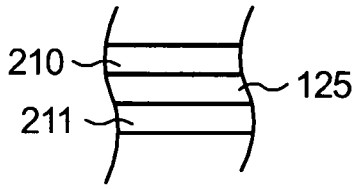
FIG. 2 is an illustrative side view of a paper sheet disposed between two press felts, according to one embodiment of the invention.
Figure 3:
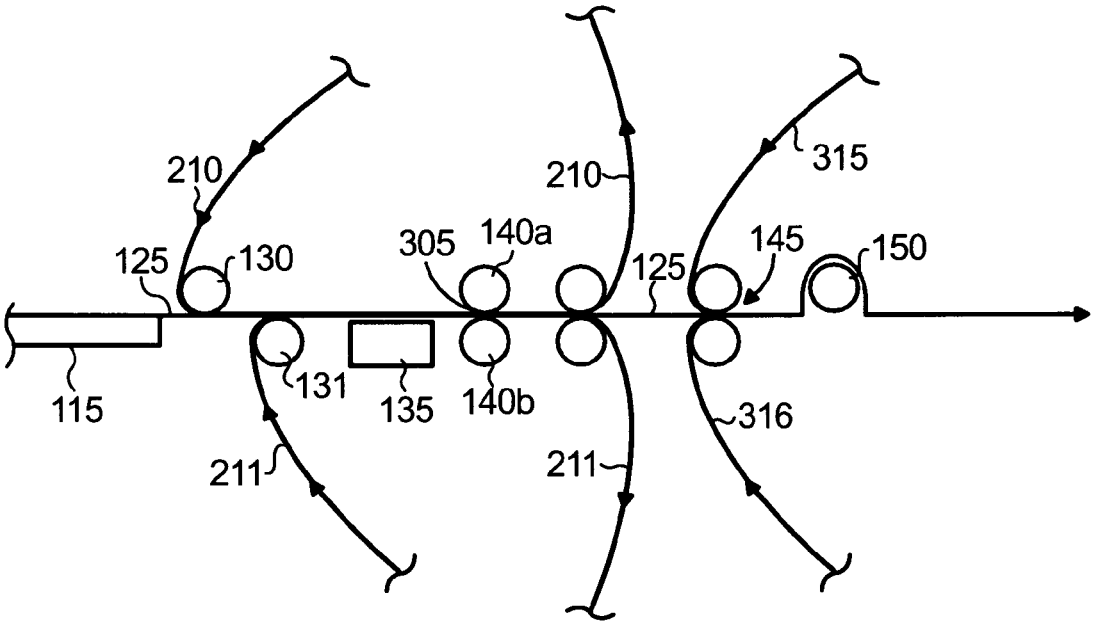
FIG. 3 is an illustrative side view schematic diagram of a press section of a papermaking machine, according to one embodiment of the invention.

Referring to FIGS. 2 and 3, in one embodiment, the thin sheet 125 supported by the press felts 210 and 211 is then advanced through the press section, which includes press roll pair 140. The thin sheet 125 and the press felts 210 and 211 are advanced to a nip 305 (the point where the press roll pairs meet) and are pressed (squeezed) between a top roll 140*a* and a bottom roll 140*b*. The pressing function serves to further squeeze out water from the thin sheet 125. In other embodiments, more press roll pairs can be used.

After the thin sheet 125 passes through the press roll pair 140, the supporting press felts 210 and 211 roll back away from the thin sheet 125 to be cleaned and dried. Devices for cleaning and drying the press felt 210 include water spraying devices and vacuum devices (which generate a suction of approximately 1-2 psi) that suck water out of the press felts 210 and 211. After the press felts 210 and 211 are cleaned and dried, the press felts 210 and 211 are then re-circulated back to contact another section of the thin sheet 125 as it moves off the wire 115. The cleaned and dried press felts 210 and 211 again act as a fresh reservoir to collect water from the next section of the thin sheet 125.

Dryer felts 315 and 316 are positioned to support the thin sheet 125 by the dryer felt feeding mechanism 145 (while first press felts 210 and 211 are being cleaned, dried, and re-circulated). Because the dryer felts 315 and 316 are clean and dry, they serve as reservoirs to draw and hold more water from the thin sheet 125. The section of the thin sheet 125 supported by the dryer felts 315 and 316 is then wrapped around the steam cylinder 150 to heat the thin sheet 125 and evaporate more water. Thereafter, the section of the thin sheet 125 is moved out of the papermaking machine 100 onto the reel (not shown). At this point, this section of the thin sheet 125 is approximately 95 percent solid material.

The present invention involves enhancing the press section of the papermaking machine 100 such that measurements of particular properties of the thin sheet 125 can be made while the thin sheet 125 is still moving through the papermaking machine 100 (in the machine direction), and then having the papermaking machine 100 perform additional functions based on the measured properties. Particular properties of the thin sheet 125 include, but are not limited to, weight, color, thickness, and water (moisture) content.

Figure 4A:
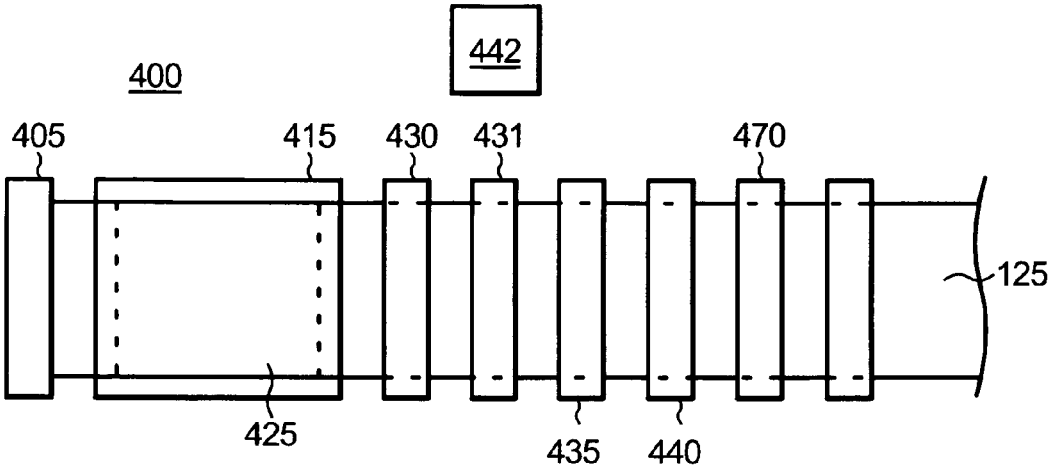
FIG. 4A is an illustrative top view schematic diagram of a papermaking machine employing a moisture measuring device, according to a second embodiment of the invention.

Referring to FIG. 4A, in a second embodiment, a schematic diagram of a papermaking machine 400 according to the invention is shown. The papermaking machine 400 includes a headbox 405, a wire 415, a suction roll 430, a press felt feeding mechanism 431, a steam box 435, a press section roll pair 440, a dryer felt feeding mechanism 445, a moisture measuring device (such as a wet press scanner) 470, a steam cylinder 450, and a control unit 442. In other embodiments, more press section roll pairs and more steam cylinders can be used.

As previously described, in order to make paper, a tree is first ground and/or chemically digested into fibers and mixed with water. The fiber-water mixture (stock) is supplied to the head box 405 via a pipe (not shown). The head box 405 distributes the stock to the wire 415 through a thin but wide slot thereby forming a continuous thin sheet 425. As the wire 415 moves the thin sheet 425 along in the machine direction, water drains from the thin sheet 425.

Underneath the wire 415 are various vacuum boxes and foils (not shown) that suck air and create pressure to further facilitate the removal of water from the thin sheet 425. By the time the thin sheet 425 has been moved by the wire 415 to the end of the forming section, the fibers stick together to maintain the integrity of the thin sheet 425.

Figure 4B:
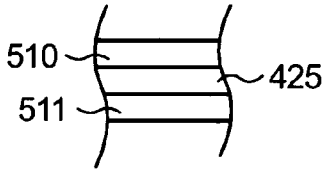
FIG. 4B is an illustrative side view of a paper sheet disposed between two press felts, according to the second embodiment of the invention.

As the thin sheet 425 is moved off the wire 415, a suction roll 430 holding press felt 510 positioned above the thin sheet 425 moves down to transfer the thin sheet 425 to the bottom side of the press felt 510 via suction. Thereafter, another press felt 511 is fed under the thin sheet 425 by the press felt feeding mechanism 431. This results in a section of the continuous thin sheet 425 being disposed between press felt 510 and press felt 511, as shown in FIG. 4B.

The section of the thin sheet 425 supported by the press felts 510 and 511 is moved past the steam box 435. Typically, the steam box 435 operates in the cross-machine direction (CD) (across the width of the thin sheet 425) and blows steam on the thin sheet 425 (in six inch increments in the cross-machine direction) which heats the thin sheet 425 and causes the remaining water to become less viscous so that the water can be more easily removed. In other embodiments, the steam box 435 blows steam on the thin sheet 425 in different increments, in different locations across the thin sheet 425, or in some other uniform size across the sheet 425.

Figure 5:
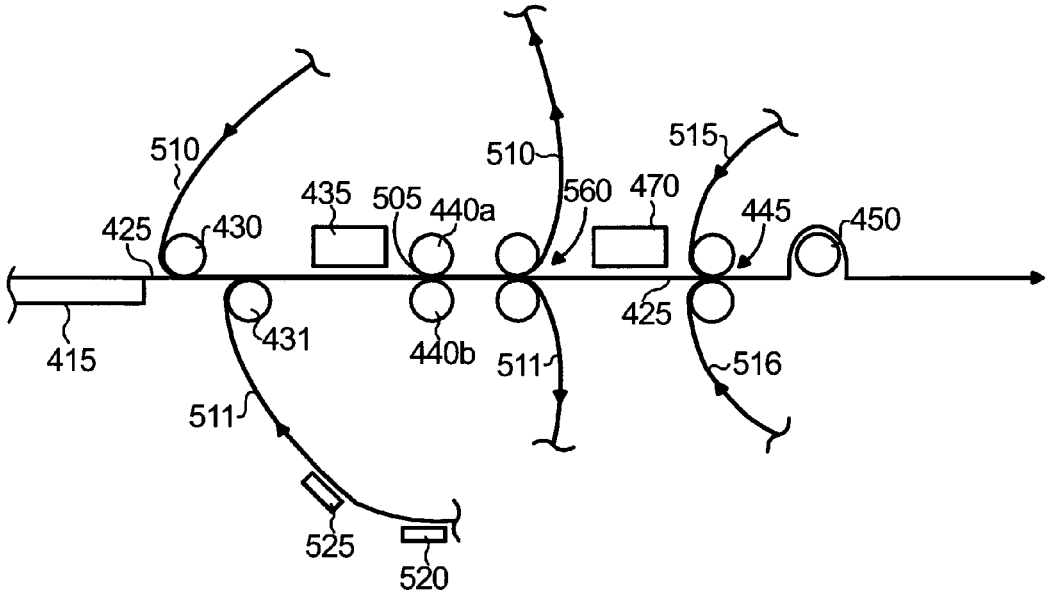
FIG. 5 is an illustrative side view schematic diagram of a press section of a papermaking machine employing a water-spraying device for wetting press felt, according to the second embodiment of the invention.

Referring to FIGS. 4A and 5, in the second embodiment, the thin sheet 425 supported by the press felts 510 and 511 is then advanced through the press section, which includes press roll pair 440 (top roll 440*a* and bottom roll 440*b*). The thin sheet 425 and the press felts 510 and 511 are advanced to a nip 505 (the point where the press roll pairs meet) and are pressed (squeezed) between the top roll 440*a* and the bottom roll 440*b*. The pressing function serves to further squeeze out water from the thin sheet 425. In other embodiments, more or fewer press roll pairs can be used.

After the thin sheet 425 passes through the press roll pair 440, the supporting press felts 510 and 511 roll back away from the thin sheet 425 to be cleaned and dried. The present invention enhances the papermaking machine 400 by including various devices to act on the press felt 510 and/or press felt 511 to enhance the press felt's ability to absorb water from the thin sheet 425.

Figure 6:
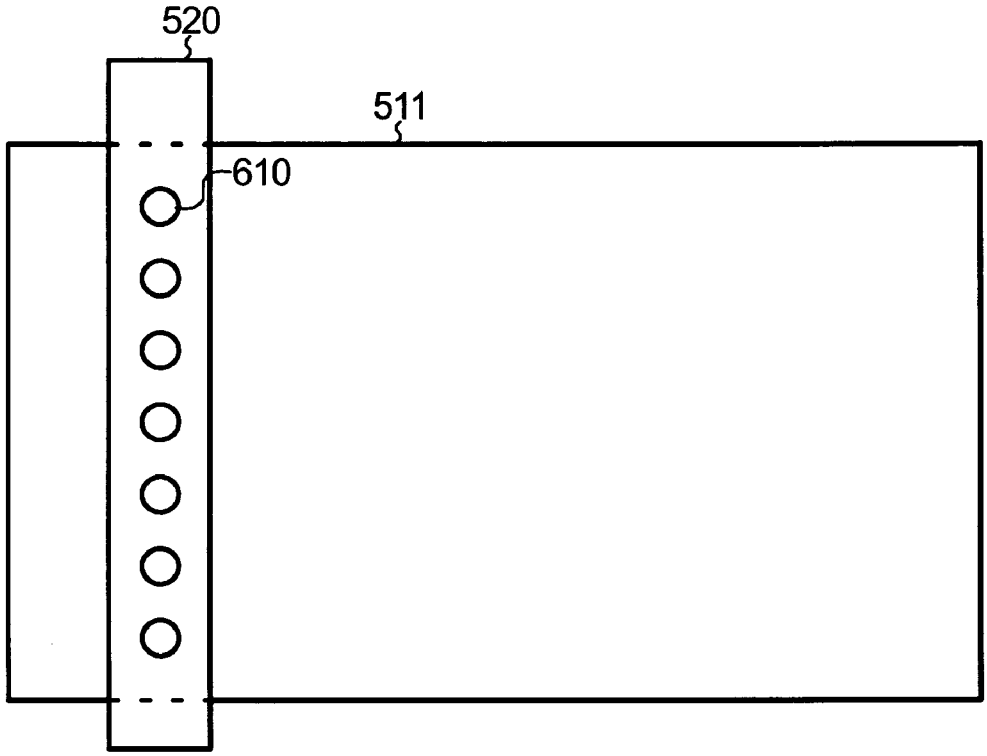
FIG. 6 is an illustrative top view schematic diagram of a cross-machine direction water spraying device, according to the second embodiment of the invention.

For example, after the press felt 511 is cleaned and dried, a water spraying mechanism 520 (shown in greater detail in FIG. 6), such as the Aqualizer™, is used to selectively re-wet or re-moisturize the press felt 511 in particular zones (via spray nozzles 610) in the cross-machine direction and the machine direction as the press felt 511 moves through the re-circulation path. The zones selected for re-wetting are determined by the moisture profile that is determined by the moisture measuring device 470 and discussed in further detail below. A vacuum device 525 is also used to remove water via suction if too much water was sprayed on the press felt 511 by the water-spraying device 520. The vacuum device 525 can be further used to partially dry the press felt 511 after the press felt 511 has been washed. If the vacuum device has removed too much water, then the spraying device can add water back in. This technique leaves the press felt 511 damp, i.e., containing an optimum water content for the most efficient absorption of water from the thin sheet 425.

In a preferred embodiment, the moisture measuring device 470 is located at the output of the press section (after the press roll pair 440 and after the press felts 510 and 511 have rolled back away from the thin sheet 425). The moisture measuring device 470 measures the moisture variation of the section of the thin sheet 425 that exits the press section. In other embodiments, moisture measurements can be taken by a traditional reel scanner.

The moisture variation measurement is used to determine the moisture profile of the thin sheet 425, which should be as flat across (CD) and along (MD) the thin sheet 425 as possible. Based on the moisture profile of the measure section of the thin sheet 425, the press felt 510 and/or the press felt 511 is acted upon by the water-spraying device 520 or like device and/or the vacuum device 525 or like device during the press felt re-circulation (clean and drying) process. These devices alter the moisture content of the press felts 510 and 511 (which alters its water absorption efficiency) in particular zones. The particular zones, in turn, alter the moisture content of a subsequent section of thin sheet 425 in the same particular zones. For example, when water is sprayed by the water-spraying device 520 on a zone that is one meter from the edge of the press felt 511, the water absorption efficiency in that zone will increase or decrease depending on the water content in that zone prior to spraying. The increased or decreased water absorption efficiency of that zone on the press felt 511 will result in more or less water being absorbed from the subsequent section of the thin sheet 425 in the same zone (one meter from the edge). This will result in that zone on the thin sheet 425 having a lower or higher moisture content respectively.

In the second embodiment, the control unit 442 is a computer with a central processing unit. The control unit 442 is in either wired or wireless communication with, and controls, the paper-making machine 400. The control unit 442 executes control algorithms that control various actuators, such as the water spraying mechanism 520, based on data received from various sensors, such as the moisture measuring device 470, for example. The control algorithm calculates set points for the various actuators and then either communicates directly with the various actuators, or communicates through another device that converts the set points into analogue voltages or currents required by the actuators. In another embodiment, the control algorithms execute on a distributed computer system.

Still referring to FIGS. 4A and 5, as the thin sheet 425 passes though the moisture measuring device 470, dryer felts 515 and 516 are circulated into position to support the thin sheet 425 by the dryer felt feeding mechanism 445. The section of the thin sheet 425 supported by the dryer felts 515 and 516 is then wrapped around the steam cylinder 450 to heat the thin sheet 425 and evaporate more water. Thereafter, the thin sheet is moved out of the papermaking machine 400 onto the reel (not shown). At this point, the thin sheet 425 is approximately 95 percent solid material.

The above-described system and method provides several advantages over typical papermaking techniques. First, the water absorption efficiency of the press felts 510 and 511 is increased. Second, by increasing the water absorption efficiency of the press felts 510 and 511, the energy required to evaporate the remaining water is reduced. Mechanical removal of water is more energy efficient than evaporation.

Energy usage is also reduced during the press felt re-circulation process. The vacuum device 525 and any press felt drying device are required to remove only the water from the press felts 510 and 511 that is necessary to reduce the water content of the press felts 510 and 511 to an amount that allows the press felts 510 and 511 to optimally absorb water from the thin sheet 425. Further, because the vacuum device 525 does not have to remove all the water from the press felts 510 and 511, the vacuum device 525 can operate with a lower suction, which reduces the stress on the press felts 510 and 511. Moreover, since all the water in the press felts 510 and 511 from the press felt washing process does not have to be removed, the amount of water sprayed by the water-spraying device 520 is reduced. Additionally, the moisture content of a paper sheet can be more accurately controlled and adjusted, which facilitates achieving a flatter moisture profile.

In another embodiment, moisture measuring devices are disposed in the press felt circulation paths to measure the moisture content of the press felts 510 and 511. In still another embodiment, a moisture measuring device measures the water content of the press felts 510 and 511 and the thin sheet 425 together. Thereafter, another moisture measuring device measures the water content of the thin sheet 425 alone. The water content of the press felts 510 and 511 is then determined by subtracting the water content of the thin sheet 425 from the water content measured for the press felts 510 and 511 and the thin sheet 425 together.

In yet another embodiment, the moisture content of the press felts 510 and 511 is determined by measuring the press felt permeability. Permeability is measured by spraying a thin jet of water into the felt. By measuring the volume of water per unit time, a measurement of permeability is achieved.

In yet another embodiment, the invention involves a method for affecting a particular characteristic of a non-woven sheet of material during manufacturing by a sheet-making machine by acting upon the machine clothing that contacts the sheet of material during manufacturing. The method includes providing a characteristic measuring device disposed in the sheet-making machine to measure the particular characteristic of the sheet of material and create a profile of the sheet of material, and then determining the particular characteristic of the sheet of material. The method further includes providing a means to affect the machine clothing, and then selecting one or more zones on the machine clothing to affect the machine clothing based on the particular characteristic profile of the sheet of material. Finally, the method includes acting on the machine clothing in the one or more selected zones to affect the particular characteristic of the sheet of material. In various embodiments, the material includes paper, board, plastic film, Mylar, textiles, or rubber. In other embodiments, the particular characteristic includes water content, material thickness, material weight, optical properties or surface properties.

Variations, modifications, and other implementations of what is described herein may occur to those of ordinary skill in the art without departing from the spirit and scope of the invention. Accordingly, the invention is not to be defined only by the preceding illustrative description.

What is claimed is:

1. A system for affecting moisture content of a sheet of paper during manufacturing by acting on a press felt that contacts a wet sheet of paper during manufacturing, the system comprising:

a first continuously circulating press felt, which has opposed major surfaces including a first inner surface and a first outer surface, such that a wet sheet of paper is in contact with a first portion of the first outer surface of the first continuously circulating press felt;

a moisture measuring device to determine the moisture content of a first section of a sheet of paper exiting a press section and to create a moisture profile along a cross direction of the first section of the sheet of paper which is located downstream from the first portion of the first outer surface of the first continuously circulating press felt that is in contact with the moving wet sheet of paper;

a first water-spraying device to selectively spray water on first selected zones on the first continuously circulating press felt, wherein the first selected zones are located along across direction in a part of the first continuously circulating press felt that is not in contact with the wet sheet of paper; and a controller that receives data from the moisture measuring device and controls the first water-spraying device such that one or more selected zones on the first continuously circulating press felt is sprayed with water the amount of water sprayed being based on the moisture profile along the cross direction of the first section of the sheet of paper so that, as the wet sheet of paper comes into contact with the first portion of the first outer surface of the first continuously circulating press felt, water is absorbed from the wet sheet of paper along the cross direction in amounts that depend on the moisture content of the one or more selected zones on the first continuously circulating press felt so that a sheet of paper exhibiting cross direction moisture uniformity is formed.

2. The system of claim 1 further comprising a vacuum device for removing water from the first continuously circulating press felt by suction.

3. The system of claim 2 wherein the controller controls the vacuum device such that water is removed from one or more other zones on the first continuously circulating press felt based on the moisture profile along the cross direction of the first section of the sheet of paper.

4. The system of claim 1 wherein the moisture profile is a moisture profile along both a cross direction and machine direction.

5. The system of claim 1 wherein the moisture measuring device comprises a scanner.

6. The system of claim 1 further comprising a second continuously circulating press felt, which has opposed major surfaces including a second inner surface and a second outer surface, such that the wet sheet of paper is also in contact with a second portion of the second outer surface of the second continuously circulating press felt.

7. The system of claim 6 further comprising:

a second water-spraying device to selectively spray water on second selected zones on the second continuously circulating press felt, wherein the second selected zones are located along a cross direction in a part of the second continuously circulating press felt that is not in contact with the wet sheet of paper and wherein the controller controls the second water-spraying device such that one or more selected zones on the second continuously circulating press felt is sprayed with water based on the moisture profile along the cross direction of the first section of the sheet of paper.

8. The system of claim 7 further comprising a second vacuum device for removing water from the second continuously circulating press felt by suction.

9. The system of claim 8 wherein the controller controls the second vacuum device such that water is removed from one or more other zones on the second continuously circulating press felt based on the moisture profile of the first section of the sheet of paper.

* * * * *